US008556787B2

(12) United States Patent
Leier et al.

(10) Patent No.: US 8,556,787 B2
(45) **Date of Patent: *Oct. 15, 2013**

(54) TILTING INVERSION EXERCISER

(75) Inventors: Christopher Henry Leier, Puyallup, WA (US); Howard Paul Schultz, Puyallup, WA (US); Lopin Wang, Taichung (TW)

(73) Assignees: Expectations, LLC, Puyallup, WA (US); Beto Engineering & Marketing Co., Ltd., Beitun, Taichung (TW)

( * ) Notice: Subject to any disclaimer, the term of this patent is extended or adjusted under 35 U.S.C. 154(b) by 173 days.

This patent is subject to a terminal disclaimer.

(21) Appl. No.: 13/199,555

(22) Filed: Sep. 2, 2011

(65) Prior Publication Data

US 2013/0059705 A1 Mar. 7, 2013

(51) Int. Cl.
*A63B 26/00* (2006.01)

(52) U.S. Cl.
USPC ..... 482/144

(58) Field of Classification Search
USPC ..... 482/130, 142–145; 601/23, 24–26, 98, 601/99
See application file for complete search history.

(56) References Cited

U.S. PATENT DOCUMENTS

| | | | | |
|---|---|---|---|---|
| 2,264,046 | A * | 11/1941 | McClellan | 482/145 |
| 4,531,731 | A * | 7/1985 | Law | 482/144 |
| 4,534,554 | A * | 8/1985 | Miller | 482/144 |
| 4,915,101 | A * | 4/1990 | Cuccia | 606/244 |
| 6,634,999 | B2 * | 10/2003 | Herbst | 482/142 |
| 7,052,448 | B2 | 5/2006 | Teeter | |
| 7,625,326 | B2 * | 12/2009 | Teeter et al. | 482/144 |
| 8,062,198 | B2 * | 11/2011 | Wei | 482/144 |
| 2009/0305856 | A1 * | 12/2009 | Pandozy | 482/140 |

* cited by examiner

*Primary Examiner* — Loan Thanh
*Assistant Examiner* — Nyca T Nguyen
(74) *Attorney, Agent, or Firm* — Charles E. Baxley

(57) ABSTRACT

A tilting inversion exerciser includes a carrier pivotally attached to a supporting stand for mounting a supporting table and for supporting a user, and a support member is engaged with the supporting table and curved upwardly from the supporting table for selectively engaging with a waist portion of the user and for supporting and massaging the waist portion of the user. The support member includes a latch element extended from each side for engaging with the supporting table and for anchoring and securing the support member to the supporting table, and the supporting table includes a number of slots and channels for engaging with the latch elements of the support member and for adjusting a curvature of the support member relative to the supporting table.

5 Claims, 8 Drawing Sheets

TILTING INVERSION EXERCISER

BACKGROUND OF THE INVENTION

1. Field of the Invention

The present invention relates to a tilting inversion exerciser, and more particularly to a tilting inversion exerciser including a support device or mechanism for massaging or supporting the back or waist portions of the users.

2. Description of the Prior Art

Various kinds of typical inversion suspension exercisers, rotational exercisers, tilting inversion exercisers etc. have been developed and comprise a table rotatably or pivotally attached to an upper portion of a lower or base support with a pivot axle, and rotatable relative to the base support for conducting various inversion or suspension exercises.

For example, U.S. Pat. No. 7,052,448 to Teeter discloses one of the typical inversion suspension exercisers comprising a table rotatably or pivotally attached to a base support with a hanger bar, for allowing the users to rotate the table relative to the base support, and to do various inversion or suspension exercises.

However, the table of the typical inversion suspension exercisers may only be used to support the back or waist portions of the users only, and the typical inversion suspension exercisers do not have support devices to massage or support the back or waist portions of the users, such that the users may use the conventional tilting inversion exercisers to conduct only the rotational or inversion exercises.

The present invention has arisen to mitigate and/or obviate the afore-described disadvantages of the conventional tilting inversion exercisers.

SUMMARY OF THE INVENTION

The primary objective of the present invention is to provide a tilting inversion exerciser including a support device or mechanism for comfortably massaging or supporting the back or waist portions of the users.

In accordance with one aspect of the invention, there is provided a tilting inversion exerciser comprising a supporting stand, a carrier pivotally attached to the supporting stand with a bearing support, a supporting table attached to the carrier for supporting a user thereon, and a support member attached to the supporting table and curved upwardly from the supporting table for selectively engaging with a waist portion of the user and for supporting and massaging the waist portion of the user.

The support member includes a first latch element extended outwardly from a first side portion thereof for engaging with the supporting table, and includes a second latch element extended outwardly from a second side portion thereof for engaging with the supporting table and for anchoring and securing the support member to the supporting table.

The supporting table includes a number of slots formed therein for engaging with the first latch element of the support member, and includes a number of channels formed therein for engaging with the second latch element of the support member and for adjusting a curvature of the support member relative to the supporting table.

The supporting table includes a primary table plate and an auxiliary table plate attached to the carrier for supporting different portions of the user, and the slots are formed in the primary table plate, and the channels are formed in the auxiliary table plate.

The primary table plate and the auxiliary table plate each include a number of the grooves formed therein. The supporting table includes a gap formed between the primary table plate and the auxiliary table plate.

The support member includes a projection extended from each of the first and the second latch elements for engaging with the supporting table and for anchoring and securing the support member to the supporting table. The support member includes at least one opening formed therein for increasing a softness of the support member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
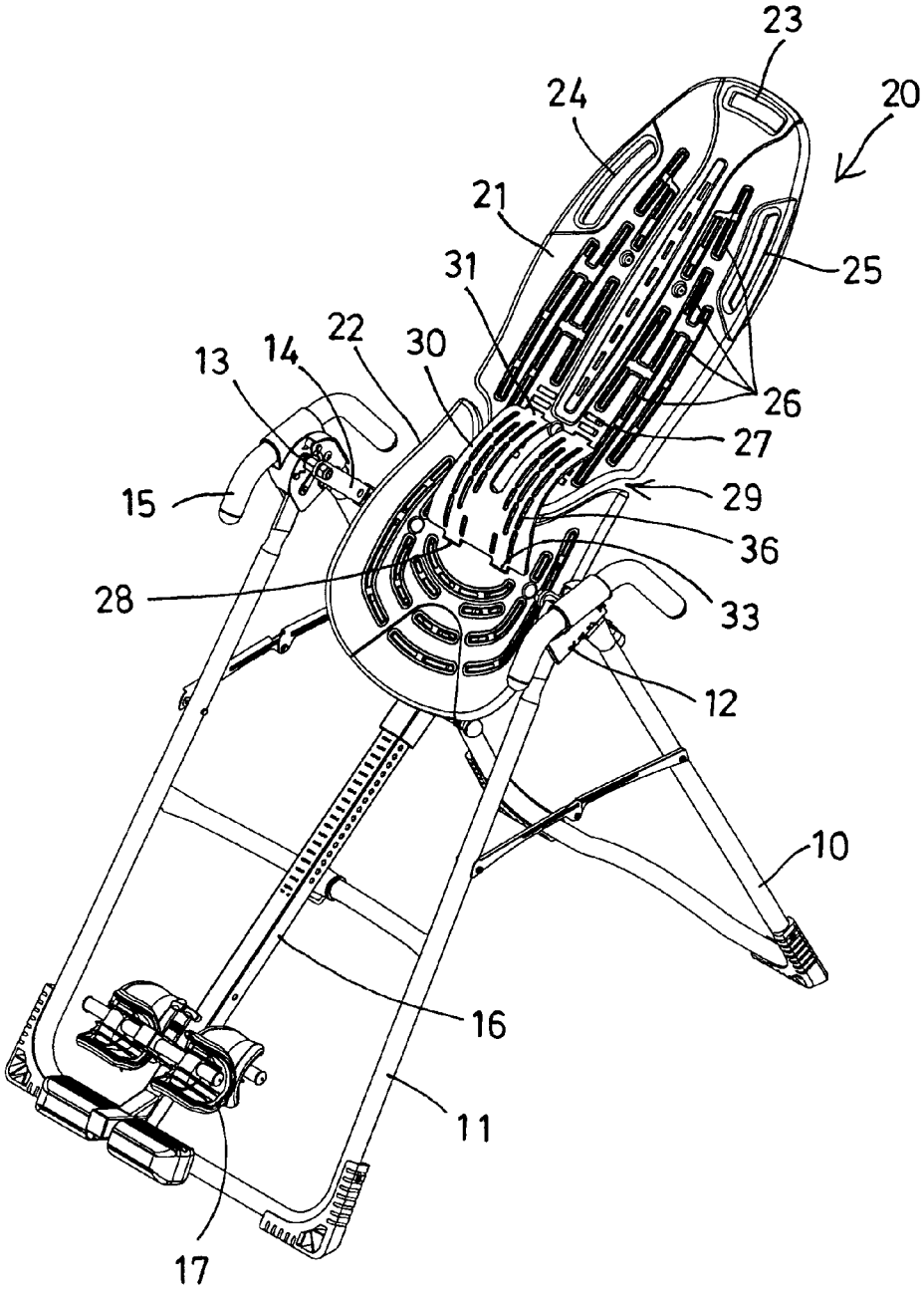
FIG. 1 is a perspective view of a tilting inversion exerciser in accordance with the present invention.
Figure 2:
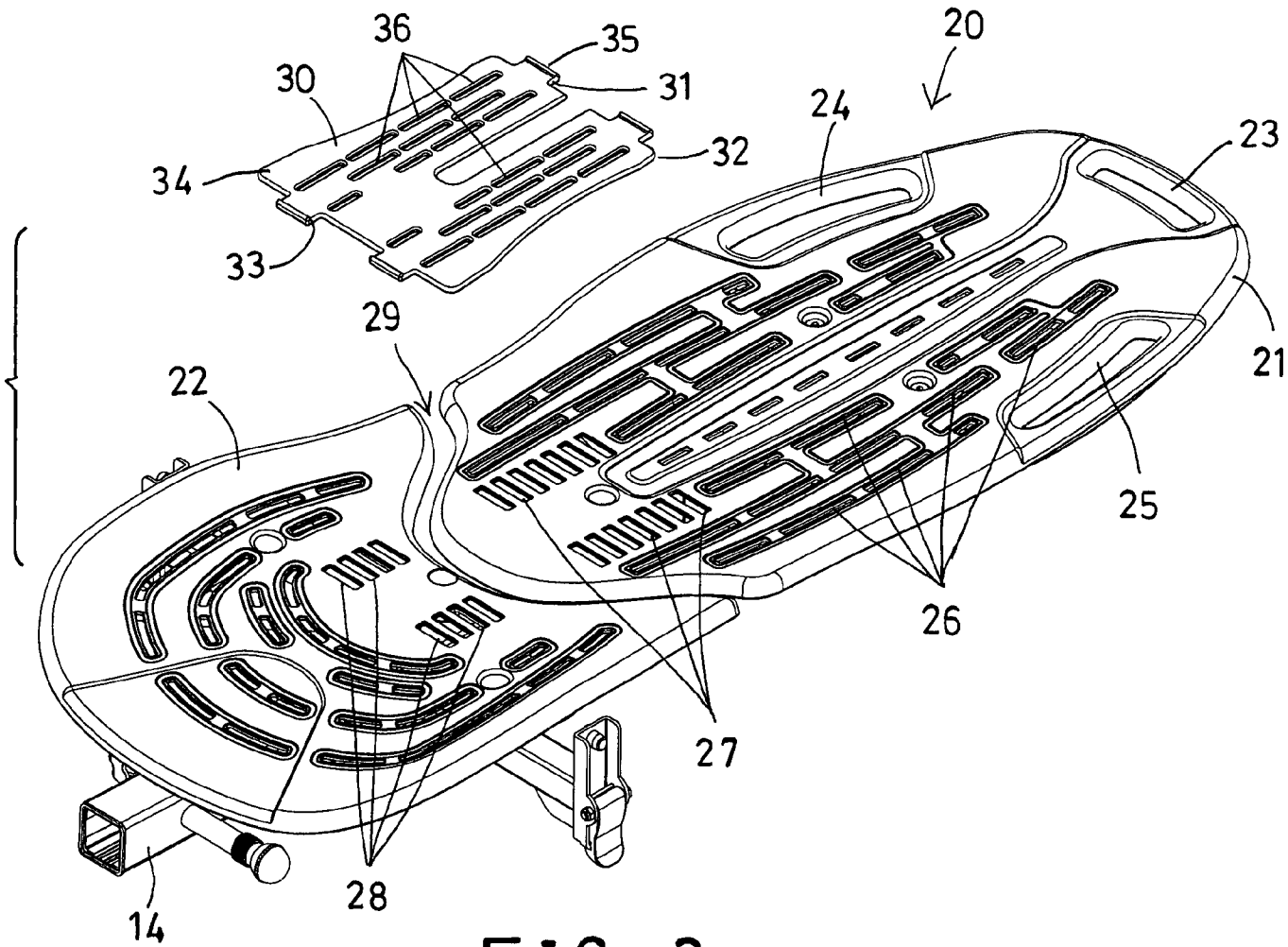
FIG. 2 is a partial exploded view illustrating a supporting table of the tilting inversion exerciser.
Figure 3:
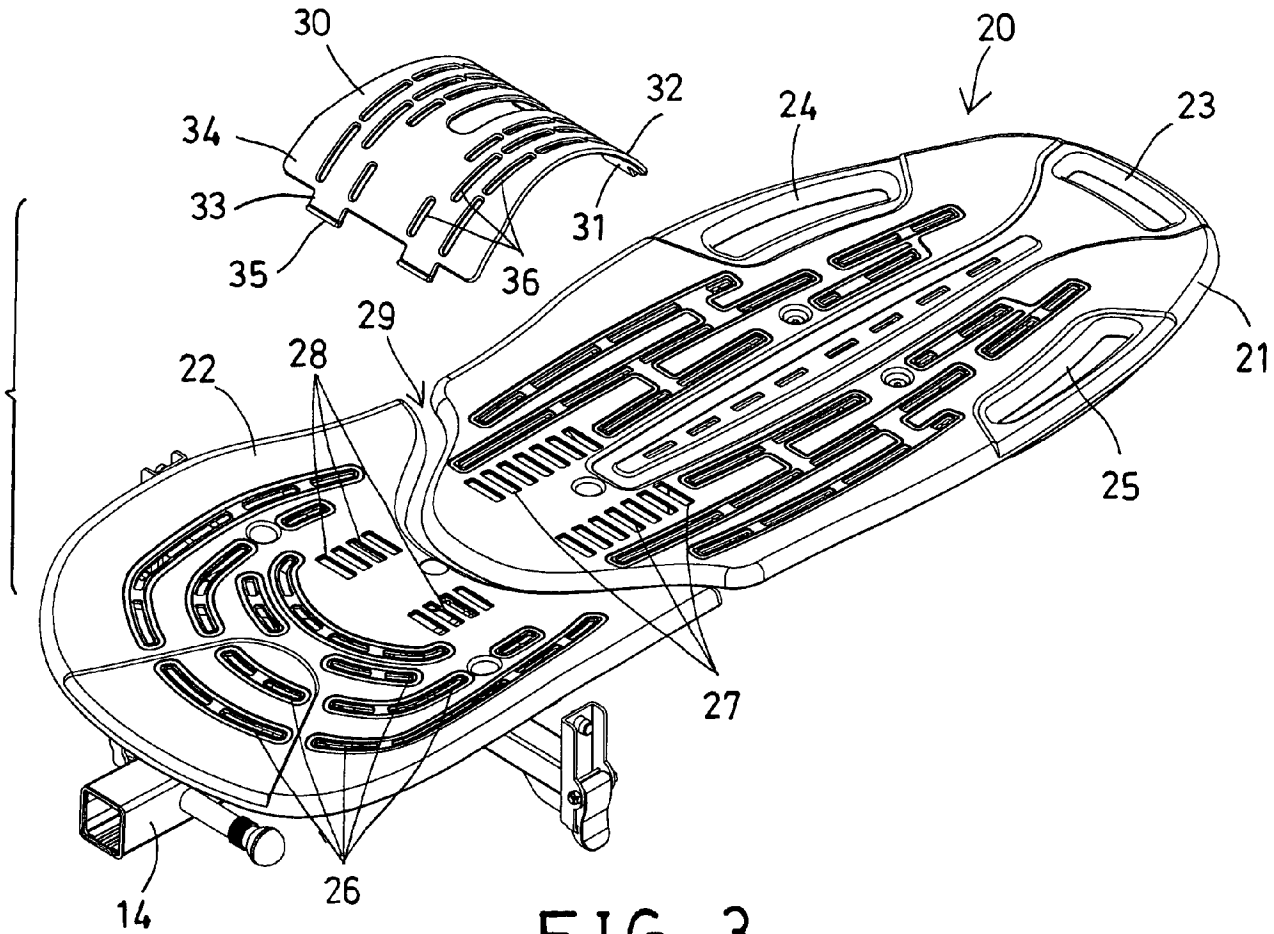
FIG. 3 is another partial exploded view of the tilting inversion exerciser.
Figure 4:
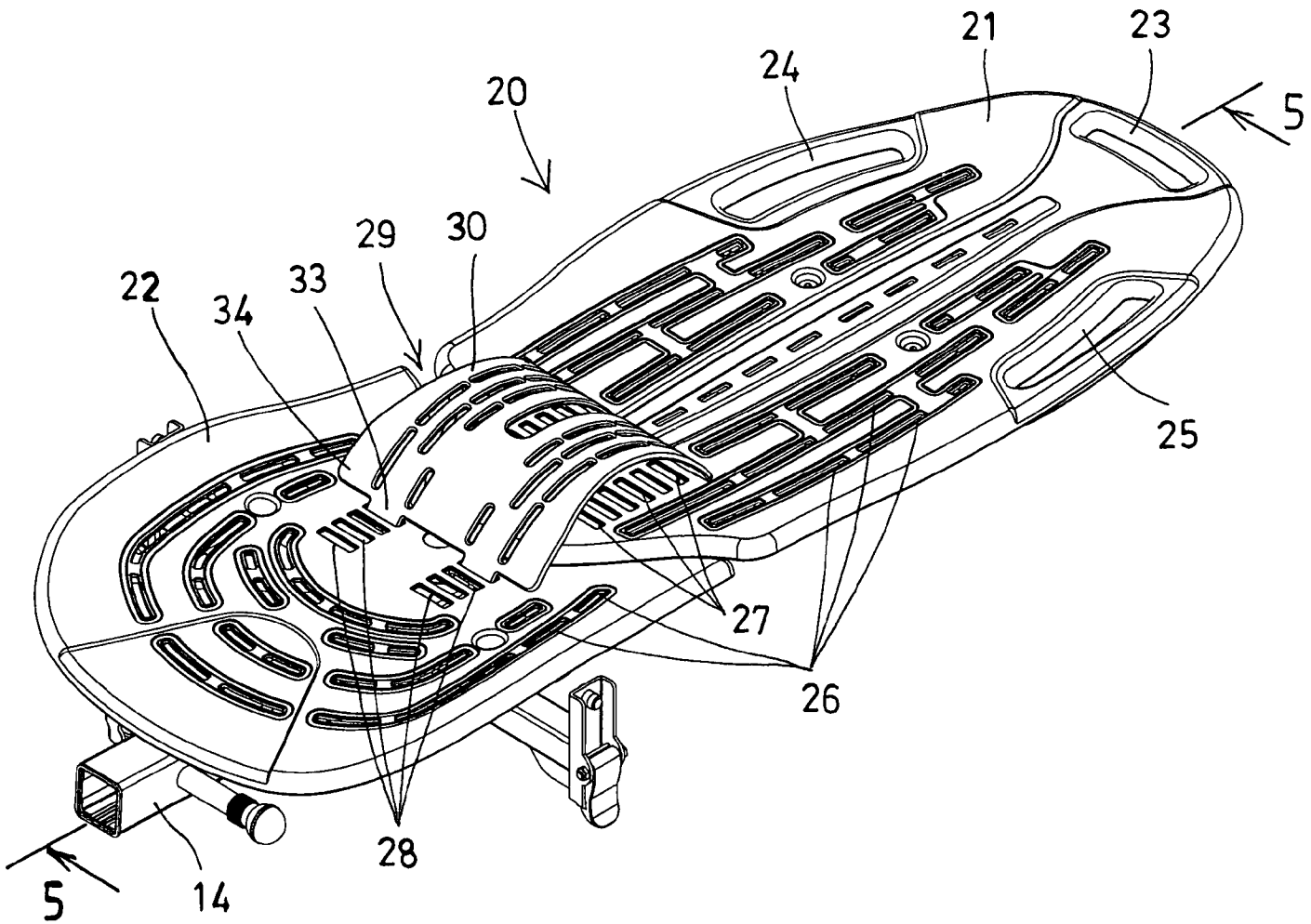
FIG. 4 is an upper perspective view of the supporting table for the tilting inversion exerciser.
Figure 5:
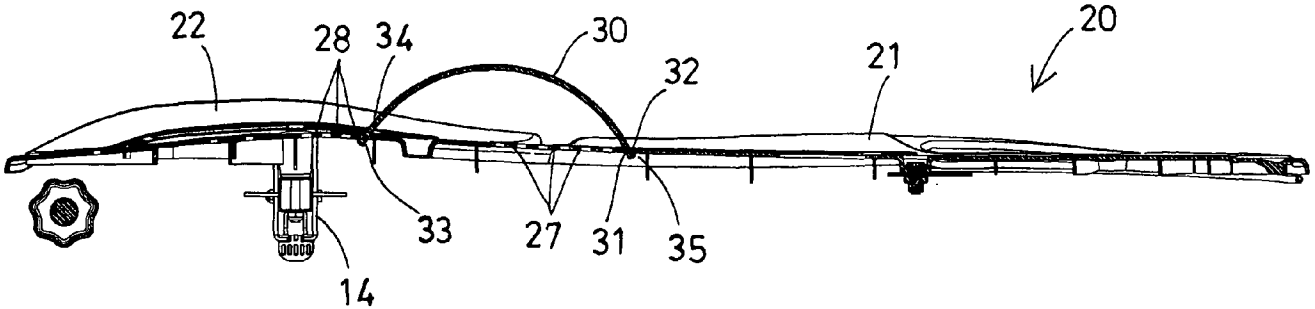
FIG. 5 is a partial cross sectional view of the tilting inversion exerciser taken along lines 5-5 of FIG. 4.
Figure 6:
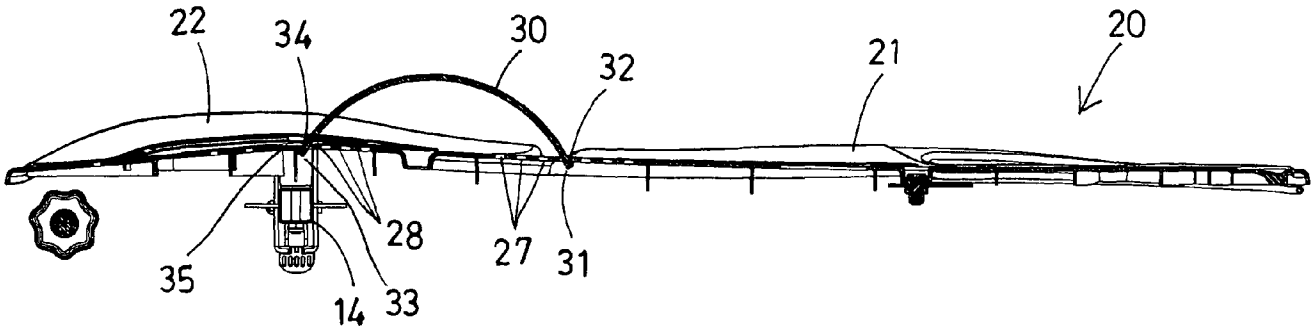
FIGS. 6, 7, 8 are partial cross sectional views similar to FIG. 5, illustrating the operation of the tilting inversion exerciser.
Figure 7:
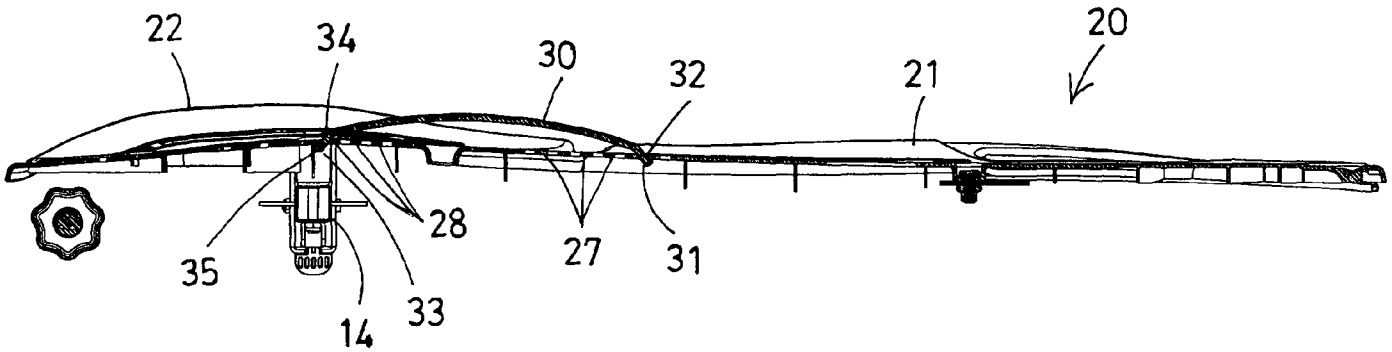
Figure 8:
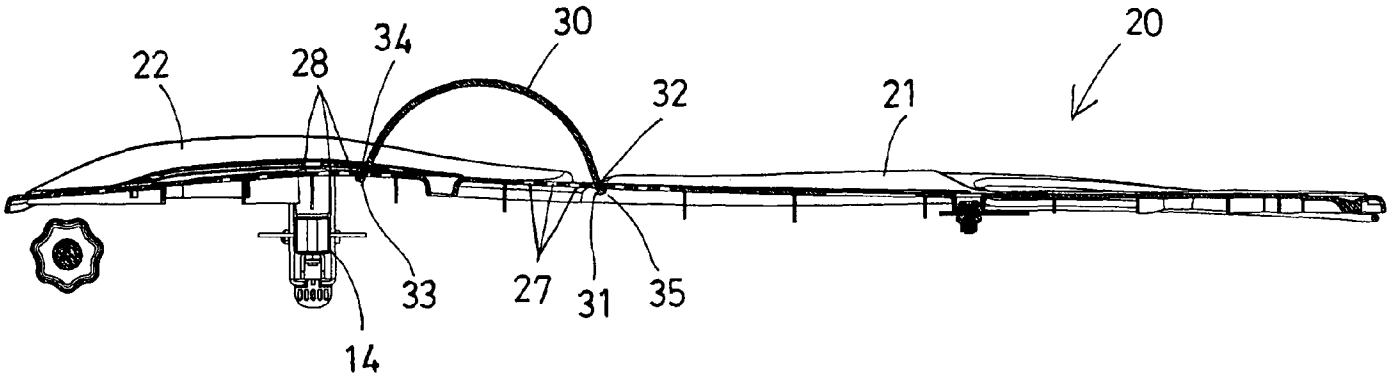
Figure 9:
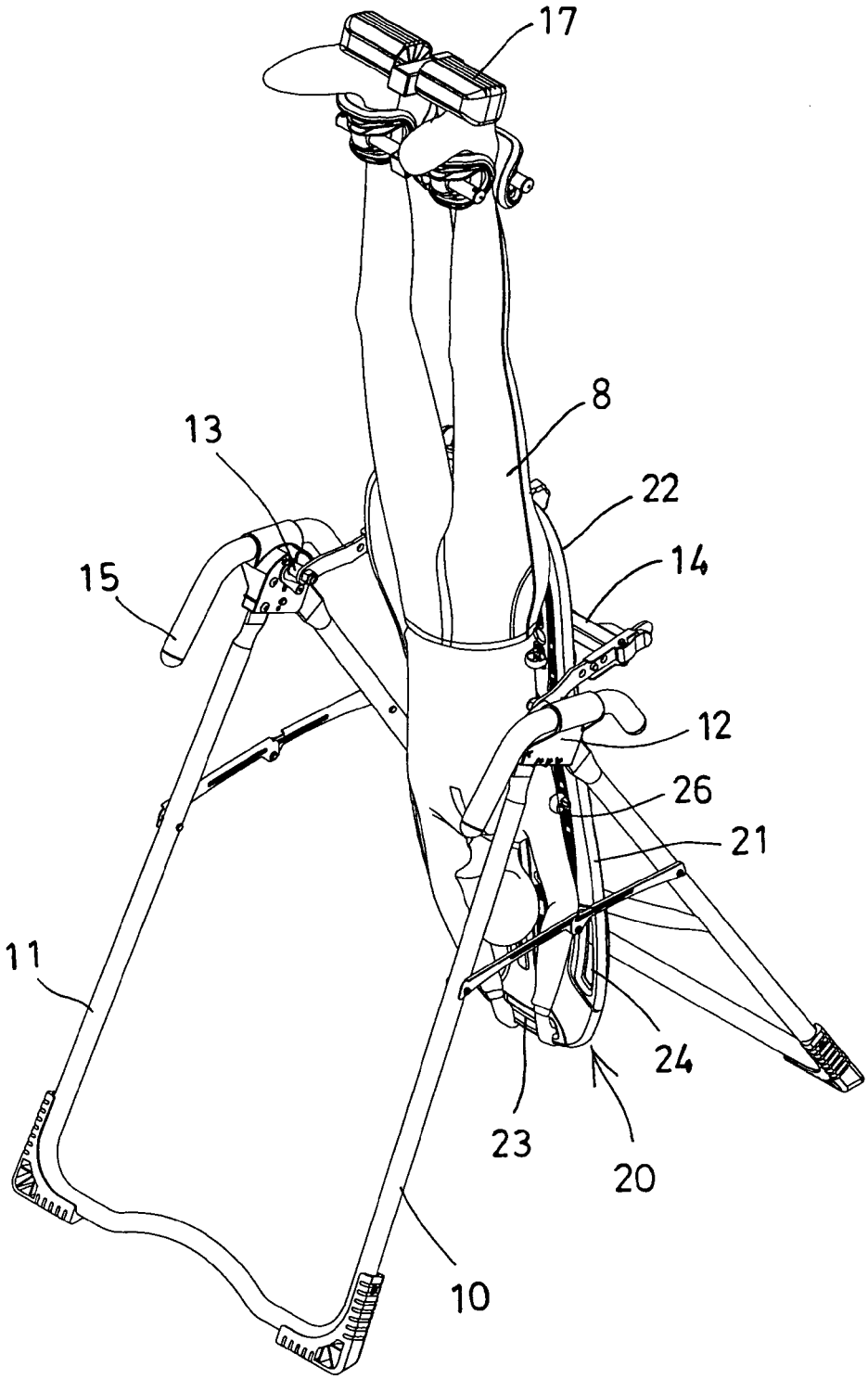
FIGS. 9, 10 are perspective views illustrating the operation of the tilting inversion exerciser.
Figure 10:
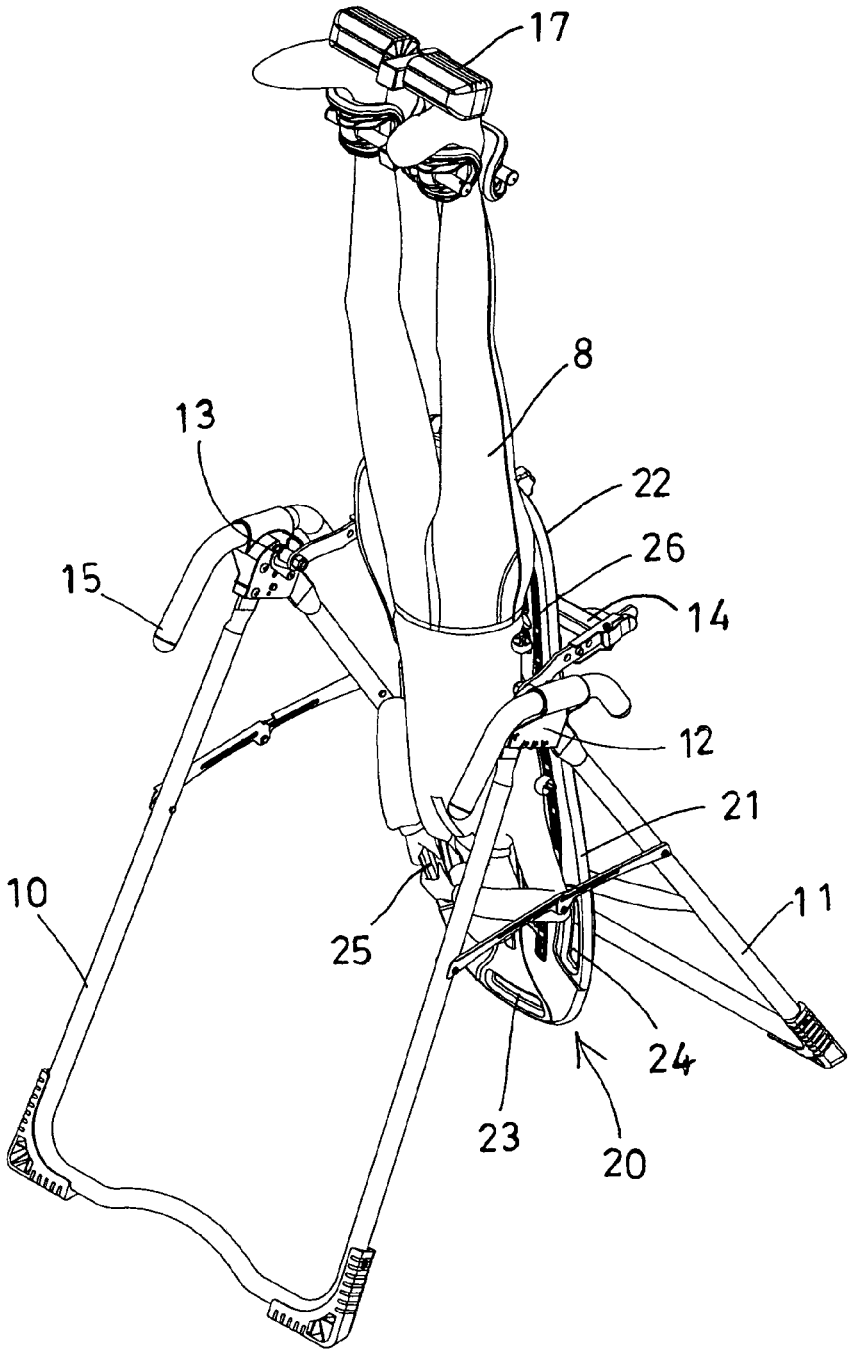

Referring to the drawings, and initially to FIGS. 1 and 9-10, a tilting inversion exerciser in accordance with the present invention comprises a lower supporting stand 10 for pivotally or rotatably supporting a base or table 20 thereon, and for supporting a user 8 on the supporting table 20 (FIGS. 9-10), the lower supporting stand 10 includes such as two U-shaped frames 11 having upper ends pivotally coupled together with two apex members 12 so as to form a substantially inverted V-shaped structure (FIGS. 1 and 9-10), and for allowing the frames 11 of the supporting stand 10 to be folded and supported between an opened working position and a folded or compact storing position. The lower supporting stand 10 includes a joint or bearing support 13 and/or a bracket or carrier 14 disposed or attached to each of the apex members 12 for pivotally or rotatably supporting or coupling the supporting table 20.

The lower supporting stand 10 includes one or more, such as two hand grips 15 formed or provided thereon, such as formed or provided on the apex members 12 respectively for being held or grasped or gripped by the user 8. The carrier 14 includes an extension 16, such as an adjustable extension 16 attached or coupled or extended from the lower portion thereof for supporting an ankle holder or foot retaining device 17 and for holding or retaining or positioning the feet of the user 8 to the carrier 14 and the supporting table 20. The extension 16 may be extended or adjusted relative to the supporting table 20 for moving or adjusting the foot retaining device 17 toward or away from the supporting table 20, according to the height of the user, for example. The above-described structure or configuration for the tilting inversion exerciser, including the lower supporting stand 10 and the carrier 14 and the hand grips 15 and the foot retaining device 17 is typical and is not related to the present invention and will not be described in further details.

The supporting table 20 includes two table plates 21, 22, such as a primary table plate 21 and an auxiliary table plate 22 attached or mounted or secured to the carrier 14 for supporting the user 8 thereon, for example, the table plates 21, 22 may include different shapes or contours or configurations and may be made of different materials for comfortably supporting different portions of the user 8, for example, the primary table plate 21 may be made of softer or resilient materials for comfortably supporting the back or the upper portion of the user 8. The primary table plate 21 may further include one or more hand grips 23, 24, 25 formed or provided thereon for being held or grasped or gripped by the user 8 (FIGS. 9-10), particularly while conducting or operating the rotational or tilting inversion exercises.

The supporting table 20 further includes a number of holes or openings or grooves 26 formed or provided in either or both of the table plates 21, 22 for air circulation purposes or the like, and includes a number pairs of slots 27 formed or provided in the primary table plate 21 and located close to the auxiliary table plate 22, and includes a number pairs of channels 28 formed or provided in the auxiliary table plate 22 and located close to the primary table plate 21, and arranged parallel to the slots 27 of the primary table plate 21. It is preferable that a space or gap 29 is formed or provided between the auxiliary table plate 22 and the primary table plate 21, and the slots 27 of the primary table plate 21 and the channels 28 of the auxiliary table plate 22 are located in the opposite sides of the gap 29 that is formed or provided between the auxiliary table plate 22 and the primary table plate 21.

As shown in FIGS. 1-4, a support member 30 is further provided and includes one or more (such as two) latch elements 31 extended outwardly from one end or one side portion 32 thereof for selectively engaging with the slots 27 of the primary table plate 21 and for anchoring or securing or retaining the one side portion 32 of the support member 30 to the primary table plate 21, and includes one or more (such as two) latch elements 33 extended outwardly from the other end or the other side portion 34 thereof for selectively engaging with the channels 28 of the auxiliary table plate 22 and for anchoring or securing or retaining the other side portion 34 of the support member 30 to the auxiliary table plate 22. It is further preferable that the support member 30 further includes a key or projection 35 extended from each of the latch elements 31, 33 for engaging with the table plates 21, 22 and for solidly and stably anchoring or securing or retaining the support member 30 to the table plates 21, 22 in different shapes or contours or configurations or curvatures (FIGS. 5-8).

The support member 30 may further include a number of holes or openings 36 formed therein for weight reducing purposes or for increasing the softness or the resilience of the support member 30. The latch elements 31, 33 of the support member 30 may be easily and quickly and readily attached or mounted or engaged with either of the slots 27 of the primary table plate 21 and the channels 28 of the auxiliary table plate 22 for adjusting the shapes or contours or configurations or curvatures of the support member 30, and the support member 30 is curved upwardly from the table plates 21, 22 of the supporting table 20 for suitably engaging with the back or waist portion of the user 8 and for comfortably massaging or supporting the back or waist portion of the user 8, particularly while conducting or operating the rotational or tilting inversion exercises. For example, as shown in FIGS. 5-8, the latch elements 31, 33 of the support member 30 may be engaged with different slots 27 of the primary table plate 21 and different channels 28 of the auxiliary table plate 22 for adjusting the shapes or contours or configurations or curvatures of the support member 30.

In operation, as shown in FIGS. 1 and 5-10, the support member 30 may be easily and quickly and readily and adjustably attached or mounted or secured to various locations of the table plates 21, 22 by engaging or inserting the latch elements 31, 33 into or through the slots 27 of the primary table plate 21 and the channels 28 of the auxiliary table plate 22, and the projections 35 of the latch elements 31, 33 may be engaged with the table plates 21, 22 for solidly and stably anchoring or securing or retaining the support member 30 to the table plates 21, 22 and for engaging with and for comfortably massaging or supporting the back or waist portion of the user 8.

Accordingly, the tilting inversion exerciser in accordance with the present invention includes a support device or mechanism for comfortably massaging or supporting the back or waist portions of the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A tilting inversion exerciser comprising:

a supporting stand, a carrier pivotally attached to said supporting stand with a bearing support, a supporting table including a primary table plate and an auxiliary table plate attached to said carrier for supporting different portions of a user thereon, and a support member attached to said supporting table and curved upwardly from said supporting table for selectively engaging with a waist portion of the user and for supporting and massaging the waist portion of the user, said support member including a first latch element extended outwardly from a first side portion thereof for engaging with said supporting table, and including a second latch element extended outwardly from a second side portion thereof for engaging with said supporting table and for anchoring and securing said support member to said supporting table, and said supporting table including a plurality of slots formed in said primary table plate for engaging with said first latch element of said support member, and including a plurality of channels formed in said auxiliary table plate for engaging with said second latch element of said support member and for adjusting a curvature of said support member relative to said supporting table.

2. The tilting inversion exerciser as claimed in claim 1, wherein said primary table plate and said auxiliary table plate each include a plurality of said grooves formed therein.

3. The tilting inversion exerciser as claimed in claim 1, wherein said supporting table includes a gap formed between said primary table plate and said auxiliary table plate.

4. The tilting inversion exerciser as claimed in claim 1, wherein said support member includes a projection extended from each of said first and said second latch elements for engaging with said supporting table and for anchoring and securing said support member to said supporting table.

5. The tilting inversion exerciser as claimed in claim 1, wherein said support member includes at least one opening formed therein for increasing a softness of said support member.

* * * * *